US008240910B2

(12) United States Patent
Orny et al.

(10) Patent No.: US 8,240,910 B2
(45) Date of Patent: Aug. 14, 2012

(54) MECHANICAL OSCILLATOR FOR TIMEPIECE

(75) Inventors: Franck Orny, La Chaux-de-Fonds (CH); Stephen Forsey, Les Brenets (CH); Johnny Girardin, Fontaines (CH)

(73) Assignee: CompliTime S.A., La Chaux-de-Fonds (CH)

( * ) Notice: Subject to any disclaimer, the term of this patent is extended or adjusted under 35 U.S.C. 154(b) by 493 days.

(21) Appl. No.: 12/519,901

(22) PCT Filed: Dec. 20, 2007

(86) PCT No.: PCT/EP2007/011287

§ 371 (c)(1),
(2), (4) Date: Jun. 18, 2009

(87) PCT Pub. No.: WO2008/080570

PCT Pub. Date: Jul. 10, 2008

(65) Prior Publication Data

US 2010/0054090 A1 Mar. 4, 2010

(30) Foreign Application Priority Data

Dec. 21, 2006 (EP) ..... 06026620
Dec. 27, 2006 (CH) ..... 2119/06

(51) Int. Cl.
*G04B 17/00* (2006.01)

(52) U.S. Cl. ..... 368/169

(58) Field of Classification Search ..... 368/169
See application file for complete search history.

(56) References Cited

U.S. PATENT DOCUMENTS

| | | | | |
|---|---|---|---|---|
| 3,676,998 | A * | 7/1972 | Simon-Vermot et al. | 368/169 |
| 3,942,317 | A * | 3/1976 | Schluep | 368/169 |
| 4,215,532 | A * | 8/1980 | Perrot | 368/168 |
| 6,354,731 | B1 * | 3/2002 | Halter | 368/148 |
| 7,306,364 | B2 * | 12/2007 | Born et al. | 368/148 |

FOREIGN PATENT DOCUMENTS

| | | |
|---|---|---|
| GB | 845 773 | 8/1960 |
| GB | 2 416 408 | 1/2006 |
| WO | WO 2004/008529 | 1/2004 |
| WO | WO 2004/029733 | 4/2004 |
| WO | WO 2005/017631 | 2/2005 |

* cited by examiner

*Primary Examiner* — Renee Luebke
*Assistant Examiner* — Jason Collins
(74) *Attorney, Agent, or Firm* — McGlew and Tuttle, P.C.

(57) ABSTRACT

Mechanical oscillator for a timepiece including a balance (10) and a hairspring (12). The balance (10) and the hairspring (12) are produced from the same material. This material is non-magnetic and has a very low coefficient of thermal expansion.

32 Claims, 3 Drawing Sheets

MECHANICAL OSCILLATOR FOR TIMEPIECE

CROSS REFERENCE TO RELATED APPLICATIONS

This application is a United States National Phase application of International Application PCT/EP2007/011287 and claims the benefit of priority under 35 U.S.C. §119 of Swiss patent application CH 0211906 filed Dec. 27, 2006 and European patent application EP 06026620.2 filed Dec. 26, 2006, the entire contents of each application are incorporated herein by reference.

FIELD OF THE INVENTION

The present invention relates to a mechanical oscillator for a timepiece, and more particularly a mechanical oscillator for a wristwatch that has a high degree of isochronism.

BACKGROUND OF THE INVENTION

Different mechanical oscillators have already been proposed for wristwatches. Generally, such oscillators are designed in the form of a hairspring-balance that produces oscillations defining the natural frequency of the oscillator. This natural frequency divides time into strictly identical units so as to order the escapement of a wristwatch to regulate the speed of its gear train. Thus the accuracy of a wristwatch depends on the frequency stability of its hairspring-balance.

Several parameters such as variations in temperature, magnetic fields and variations in the amplitude of the oscillations of the balance affect the frequency stability of a hairspring-balance. Variations in temperature are capable of causing thermal expansions of the balance and of the hairspring which essentially give rise to a variation in the moment of inertia of the balance as well as a variation in the restoring torque of the hairspring. Magnetic fields essentially act on the hairspring and are capable of disturbing or even cancelling out its action on the balance. Variations in the amplitude of the oscillations of the balance are linked to the weight and inertia of the balance and are capable of leading to an isochronism defect of the hairspring-balance. Thus, all these parameters are capable of altering the natural frequency of the hairspring-balance.

To compensate for variations in temperature, the materials used for the production of the balance and hairspring in the mechanical oscillators used most often are chosen such that the respective variations in the moment of inertia of the balance and the restoring torque of the hairspring compensate for each other. Of the proposed solutions, the use of a beryllium copper alloy balance associated with a hairspring produced from specially designed alloys, such as for example invar and elinvar, which is a nickel-iron alloy having a very low expansion coefficient must be noted in particular. However, this type of hairspring-balance is still sensitive to magnetic fields. Thus, the search for new alloys that can be used for the production of the hairspring continues, as shown for example by the development of Silinvar™. The self-compensating result of these alloys is above all the result of two opposing influences, in particular that of the temperature and that of the magnetostriction on the modulus of elasticity of the metal.

To compensate for the effects of the magnetic fields other than by using new alloys specially designed for this purpose, it has also been proposed that the hairspring be produced from a non-magnetic material, such as quartz for example, while producing the balance from beryllium copper as described above. However, this type of hairspring-balance is sensitive to variations in temperature.

To compensate for the variations in the amplitude of the oscillations of the balance in order to minimize its isochronism defect, certain factors must be taken into consideration, including the asymmetry of the expansion and contraction of the hairspring, the changes in the elasticity of the hairspring in response to changes in temperature, magnetic fields, the attachment points of the hairspring, centrifugal forces and gravity, the balancing of the balance, friction and geometry. Minimizing the isochronism defect is crucial for optimizing the accuracy of mechanical watches.

This consists in the production of a hairspring-balance having a high degree of isochronism allowing it to generate equal oscillations independent of their amplitude. Thus, a balance that is as light as possible with as much inertia as possible is often used.

An example of a hairspring-balance designed to remedy the problems described above is illustrated in WO 2004/008529 A1. This hairspring-balance is provided with a balance comprising a non-magnetic ceramic for which the coefficient of thermal expansion is positive and less than $+1*10^{-6}$ $K^{-1}$. The hairspring is manufactured from a continuous carbon fibre composite with a texture that is twisted or parallel in relation to the axial direction of the fibre. These fibers are encased in a thermosetting, thermoplastic or ceramic polymer matrix. The coefficient of thermal expansion of this composite is negative and greater than $-1*10^{-6}$ $K^{-1}$. More particularly, the materials used for the production of the balance and hairspring are selected such that the values of their coefficients of thermal expansion are similar, very low and of opposite signs. Thus, this hairspring-balance allows for a high level of accuracy and a more stable functioning of the oscillator to be obtained as a result of a self-compensating effect of the hairspring.

SUMMARY OF THE INVENTION

The object of the present invention is to at least considerably reduce the self-compensating effect of the hairspring. Thus, the present invention proposes a hairspring-balance that, in wide temperature ranges, is resistant to variations in temperature to avoid the expansion and variation in the moment of inertia of the balance. More generally, the object of the present invention is to propose a hairspring-balance having improved frequency stability as regards its sensitivity to variations in both temperature and amplitude, as well as to magnetic fields.

This object is achieved by a mechanical oscillator comprising a balance and a hairspring having the characteristics of the present invention.

More particularly, this object is achieved by a mechanical oscillator according to the invention, characterized by the production of the balance and the hairspring from the same material. This production of the balance and the hairspring from the same material allows for the avoidance of the compensating effect of the hairspring in relation to the balance, which thus has an almost constant inertia. Because of this, the self-compensation between the balance and the hairspring becomes negligible.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

In the following detailed description of the attached drawings, identical components are given identical reference numbers. Generally, these components and their functionalities are described once only for reasons of brevity in order to avoid repetitions.

Figure 1:
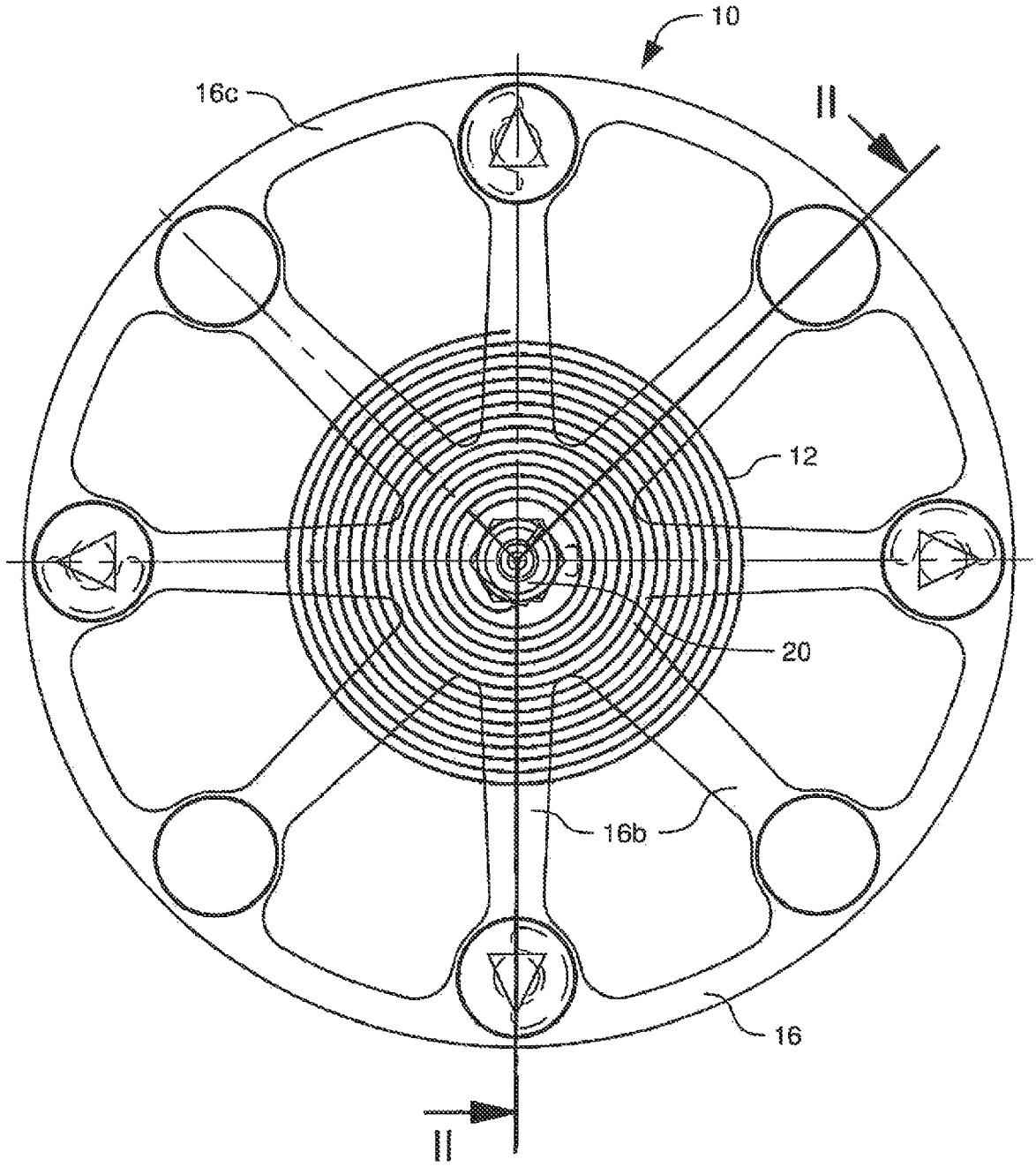
FIG. 1 is an enlarged top view of a mechanical oscillator according to the invention.
Figure 2:
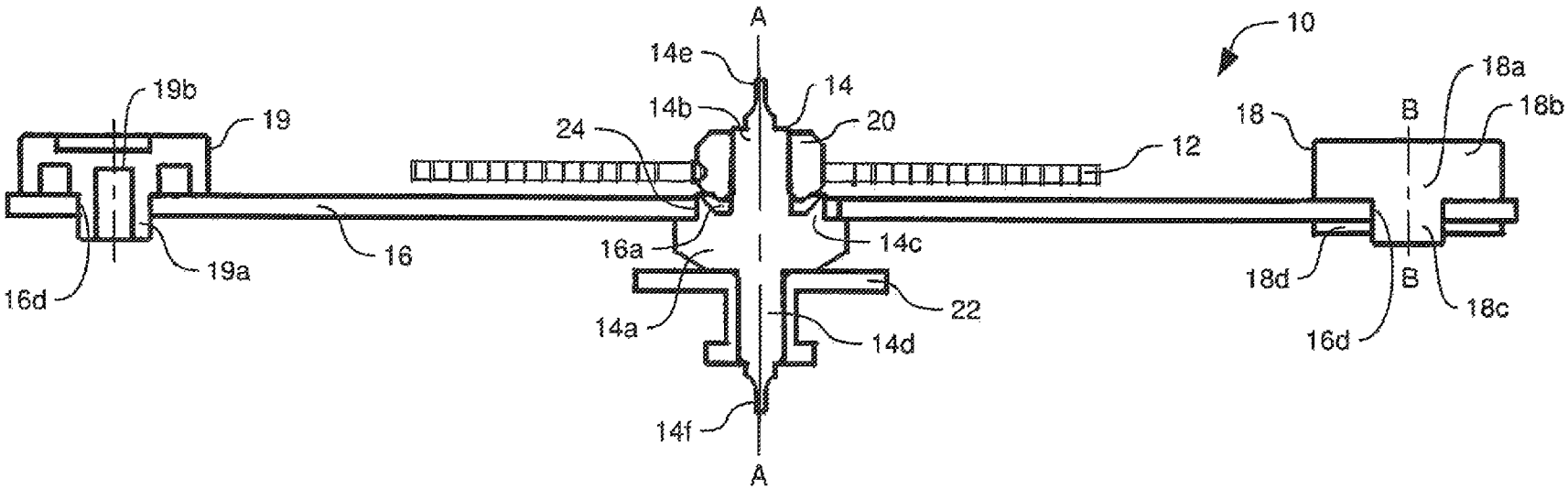
FIG. 2 is an enlarged cross-sectional view of the mechanical oscillator in FIG. 1.

FIGS. 1 and 2 illustrate by way of example a hairspring-balance type mechanical oscillator comprising a balance 10 and a hairspring 12. The balance 10 comprises an arbor 14, a plate 16 mounted rigidly on the arbor 14 and counterweights of a first type 18 and of a second type 19, a collet 20 and a roller 22. The hairspring 12 is produced from a material that may or may not be the same as that used to produce the plate 16 of the balance 10.

According to a preferred embodiment of the present invention, the hairspring 12 is produced from the same material as the balance 10. More specifically, the hairspring 12 and the plate 16 of the balance 10 are produced from the same material. This production of the balance 10, and/or its plate 16, and the hairspring 12 from the same material allows for the avoidance of the compensating effect of the hairspring 12 in relation to the balance 10, which thus has an almost constant inertia. Because of this, the self-compensation between the balance 10 and the hairspring 12 is almost negligible.

The material chosen to produce the balance 10, and/or its plate 16, as well as the hairspring 12, is preferably nonmagnetic and has the advantage of having a coefficient of thermal expansion of 20 to $2*10^{-10}/°$ C. at most. This coefficient of thermal expansion is preferably $5\cdot10^{-6}/°$ C., and even more preferably $2\cdot10^{-6}/°$ C. at most. The apparent density of the material is preferably comprised in a range from 2.0 to 5.0 g/cm$^3$, preferably from 2.5 to 4.5 g/cm$^3$, and even more preferably from 3 to 4.0 g/cm$^3$.

According to a preferred embodiment of the present invention, this material is diamond or synthetic diamond and, more generally, a diamond-based material. Nevertheless, other materials can be used, as described in more detail below, such as, for example, quartz, silicon, carbon, titanium or ceramic.

As FIG. 2 shows, the arbor 14 of the balance 10 has an axis of symmetry, referred to as the axis AA, that is also its swivel axis. The arbor 14 is conventionally produced from hardened steel and comprises a seat 14*a*, cylindrical parts 14*b*, 14*c* and 14*d* arranged on either side of the seat 14*a* and intended to accommodate respectively the collet 20, the plate 16 and the roller 22. Its ends form pivots 14*e* and 14*f* intended to be fitted into bearings created in the frame of the timepiece, not shown on the drawing.

The plate 16 comprises a central hole 16*a* and eight radially oriented openings defining eight arms 16*b*. The outer ends of the arms 16*b* are joined together to form a felloe 16*c*. This latter is pierced, in the extension of the arms 16*b*, by holes 16*d* oriented parallel to the axis AA and in which the counterweights 18 and 19 are fixed. The base of the felloe 16*c* can be produced in a different material from the plate 16. In this case, if the plate 16 is, for example, produced from diamond, a diamond coating can be applied to the felloe 16*c* so as to obtain the same physical characteristics for the felloe 16*c* as for the plate 16.

More particularly, according to a preferred embodiment of the present invention, the balance 10 and/or the hairspring 12 are coated in nanoparticles of a material that is preferably nonmagnetic and has the advantage of having a coefficient of thermal expansion of 20 to $2*10^{-10}/°$ C. at most. This coefficient of thermal expansion is preferably $5\cdot10^{-6}/°$ C., and even more preferably $2\cdot10^{-6}/°$ C. at most. The apparent density of said material is preferably comprised in a range from 2.0 to 5.0 g/cm$^3$, preferably from 2.5 to 4.5 g/cm$^3$, and even more preferably from 3 to 4.0 g/cm$^3$. Preferably, the balance 10 and the hairspring 12 have a nanodiamond coating. This coating can also be advantageously applied to a hairspring-balance known to the person skilled in the art, such as, for example, a hairspring-balance comprising a balance produced from beryllium copper alloy associated with a hairspring produced from specially designed alloys such as for example invar.

As can be seen more particularly in FIG. 2, the plate 16 is resting against the seat 14*a* and positioned by the cylindrical part 14*c*. It is fixed to the arbor 14 by adhesive dots 24 arranged in housings made in the periphery of the hole 16*a*. The collet 20 is pressed onto the arbor 14 in its cylindrical part 14*d*, resting against the plate 16. It holds the hairspring 12, which is attached with adhesive.

The plate 16 is formed of a sheet of a material with a low density and a low coefficient of thermal expansion, such as for example diamond, corundum, quartz or silicon, and with a thickness in the order of a few tenths of a millimeter. More particularly, this thickness is preferably comprised in a range from 0.05 mm to 0.3 mm, and it typically has value of 0.2 mm. As mentioned above, the hairspring 12 is produced from a material that may or may not be the same as that used to produce the balance 10 and/or its plate 16. Thus, the material used to produce the hairspring 12 can also be selected from the materials listed above by way of example, i.e. diamond, quartz, silicon or corundum. The elasticity and length of these materials vary very little according to the temperature.

The counterweights 18 are each formed of a nail 18*a* with a cylindrical shape having an axis of symmetry, referred to in FIG. 2 as the axis BB, from a heavy material with a density greater than 15 g/cm$^3$, for example gold or platinum, provided with a head 18*b* and a body 18*c*, and a ring 18*d* produced from the same material. The body 18*c* of each of the counterweights 18 is fitted into a hole 16*d*, the head 18*b* resting against the plate 16. The associated ring 18*d* is fixed on the other side of the plate 16, by pressing, gluing or welding.

The counterweights 18 have a symmetrical structure in relation to the axis BB of each of the nails 18*a*. In this way, when the temperature changes, the nails expand or contract radially in relation to the axis BB, but their center of gravity does not move. As a result, in a first approximation, this expansion does not alter the inertia of the balance.

The counterweights 19 have a center of gravity that is offset in relation to the axis of the hole 16*d* into which they are fitted. In this way, it is possible, by turning them, to alter the moment of inertia and thus correct the frequency of the oscillator. In order to allow this rotation, the counterweights 19 comprise a cylindrical part 19*a* provided with axially oriented slots 19*b*, allowing for a friction fastening.

As mentioned above, the material used to produce the balance 10 and the hairspring 12 of the mechanical oscillator according to the present invention is capable of having little sensitivity to temperature. Moreover, this material is capable of conforming to the margins established by the chronometer standards of Swiss watchmaking given in Table 1 illustrated below.

TABLE 1

Chronometer standards of Swiss watchmaking:

| Disqualifying criteria | | Minimum requirements (s/d) Categories 1 (Ø > 20 mm) | 2 (Ø ≦ 20 mm) |
|---|---|---|---|
| Mmoy | Average daily rate | −4 +6 | −5 +8 |
| Vmoy | Average rate variation | 2 | 3.4 |
| Vmax | Greatest rate variation | 5 | 7 |
| D | Difference between horizontal and vertical | −6 +8 | −8 +10 |
| P | Greatest rate difference | 10 | 15 |
| C | Thermal variation | ±0.6 | ±0.7 |
| R | Rate recovery | ±5 | ±6 |

Non-limiting examples of materials satisfying the criteria indicated in Table 1, which can thus be used within the context of the present invention, are diamond, titanium, ceramic and quartz, as already described in more detail above. These materials have the following physical properties:

Apparent density:

Diamond: 3.515 g/cm$^3$

Grade 5 titanium: 4.42 g/cm$^3$

Ceramic $Al_2O_3$: 3.9 g/cm$^3$

Quartz: 2.6 g/cm$^3$

Coefficient of thermal expansion:

Diamond: 1.10°/° C.

Grade 5 titanium: $9\cdot10^{-6}$/° C.

Ceramic $Al_2O_3$: $8\cdot10^{-6}$/° C.

Quartz: $0.5\cdot10^{-6}$/° C.

By specifically choosing the non-magnetic material used to produce the balance 10, and/or its plate 16, as well as the hairspring 12, a low coefficient of thermal expansion and an optimized mass-radius ratio are obtained. More particularly, as the mechanical oscillator in FIGS. 1 and 2 comprising the balance 10 and the hairspring 12 is produced from a material that is very stable in relation to the temperature, its frequency is very stable and varies very little depending on the temperature. This frequency stability is increased by the fact that the counterweights 18 have a fixed center of gravity in relation to the axis of the balance 10. This allows a high degree of isochronism of the mechanical oscillator to be achieved according to a preferred embodiment of the present invention, as illustrated in FIG. 3.

Figure 3:
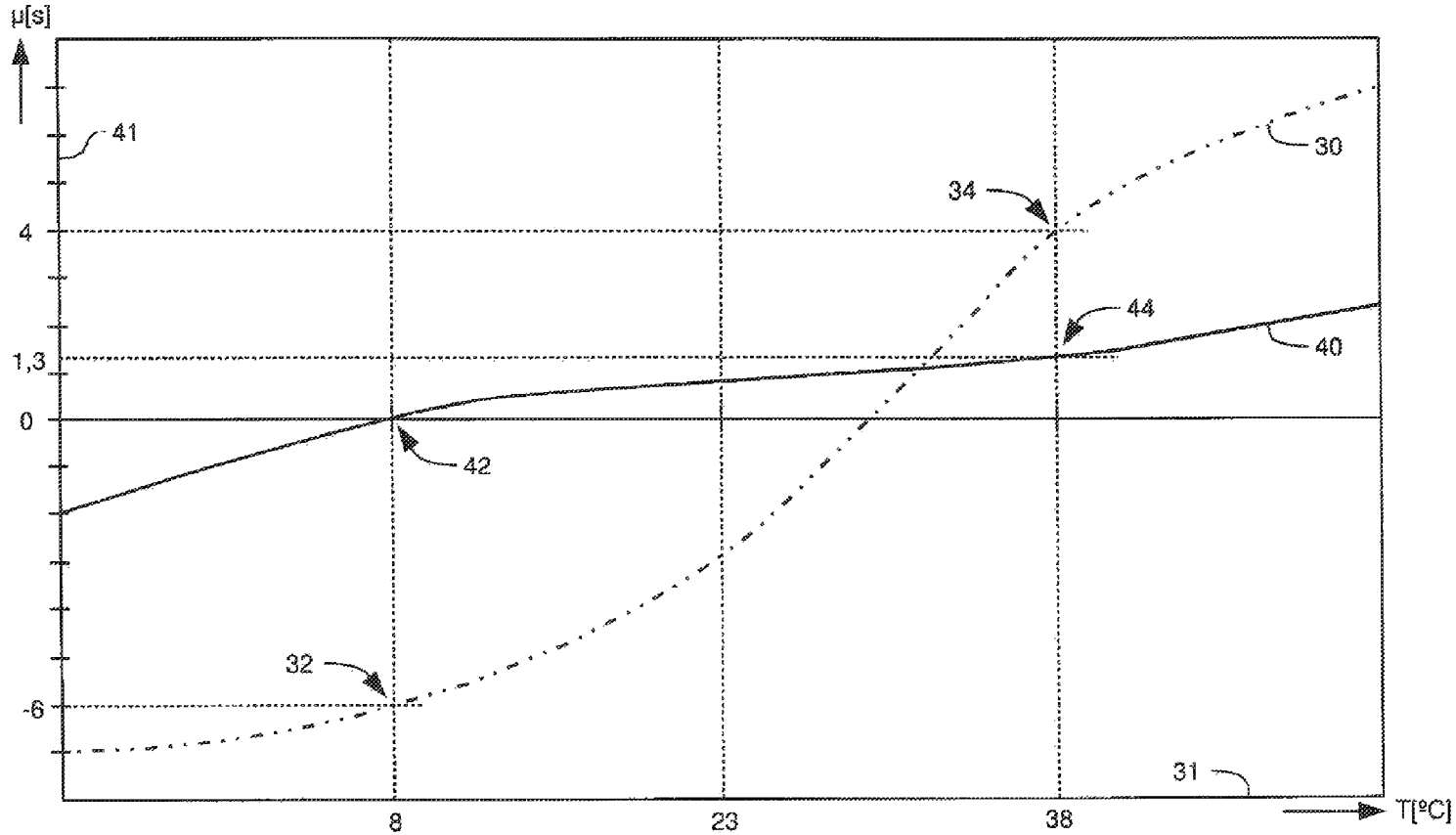
FIG. 3 is a diagram showing daily rate variations of two different mechanical oscillators.

FIG. 3 illustrates a diagram showing example daily rate variations of two different mechanical oscillators by way of example. These daily rate variations are represented in seconds ([s]) on an axis 41, depending on the different temperatures at which the corresponding mechanical oscillators were tested. These temperatures are represented in degrees Celsius ([° C.]] on an axis 31.

A first curve 30 illustrates a daily rate variation of a timepiece comprising a standard mechanical oscillator. As FIG. 3 shows, this variation in daily rate is comprised between being 6 seconds fast, as point 32 indicates, and 4 seconds slow, as point 34 indicates, when the timepiece is tested in a range of temperatures between +8 and +38° C.

A second curve 40 illustrates a daily rate variation of this timepiece when it is produced with a mechanical oscillator according to a preferred embodiment of the present invention. As FIG. 3 shows, in this case the daily rate variation is comprised between not running fast at all, as point 42 indicates, and being approximately 1.3 seconds slow, as point 44 indicates, during testing of the timepiece in the range of temperatures comprised between +8 and +38° C.

It must be pointed out, nevertheless, that this frequency stability relative to the temperature of the mechanical oscillator according to the invention is added to other advantages obtained by the choice of the material used. For example, because the materials making up the balance 10 and the hairspring 12 are non-magnetic, a magnetic field cannot interact with them. Only in the configuration described above, which uses the arbor 14 produced from hardened steel, can a magnetic field interact with this arbor 14, but the influence of this interaction is practically zero.

Finally, as the specific gravity of the material from which the plate 16 is made is low, while that of the material from which the counterweights 18, 19 are made is high, the total mass of the balance 10 is low for a given moment of inertia. The result is that the isochronism defect can be further reduced.

The gold or platinum counterweights 18, 19 allow for the balance 10 to be produced with a particularly favorable moment of inertia/mass ratio. It is also possible to use less costly materials, for example brass or invar. In the latter case, the expansion of the counterweights 18, 19 could be further reduced.

Generally, balances for timepieces must be balanced. This can be done by removing or adding material. This operation is carried out particularly advantageously by working on the counterweights 18, which have a symmetrical structure in relation to their axis BB. Moreover, at least one part of said counterweights 18 preferably has a cylindrical shape with an axis BB in the part of it that is fitted into the plate 16. In order to prevent their symmetry from being affected, it is possible to remove material either mechanically or by firing a laser at it, ensuring that this is done evenly across the whole surface or symmetrically in relation to the axis BB. It is also possible to add material by spraying onto one or other of the counterweights 18, still ensuring that the symmetry is maintained in relation to the axis BB. Thus, the present invention also claims a method of balancing by removing or adding material from/to the balance 10, characterized by the fact that material is removed from at least one of said counterweights 18 symmetrically in relation to the axis of the cylinder or by the fact that the balance is achieved by adding material to at least one of the counterweights 18 symmetrically in relation to the axis of its cylinder.

Finally, the material used to produce the counterweights 18 preferably has a specific gravity greater than 10. It can in particular be produced from gold or platinum, while the balance 10 and the hairspring 12 are produced from diamond. In this way, the ratio between the moment of inertia and the specific gravity is particularly favorable.

It must also be pointed out that, depending on the material from which the plate 16 is made, it is also possible to add material to it or remove material from it, and more particularly on the felloe 16*c*.

Although a particular embodiment is described above, several variations can be applied to the mechanical oscillator according to the invention without altering its functionality. As a result, all these variations are also envisaged and generally contemplated.

While specific embodiments of the invention have been shown and described in detail to illustrate the application of the principles of the invention, it will be understood that the invention may be embodied otherwise without departing from such principles.

The invention claimed is:

1. A mechanical oscillator for a timepiece comprising:

a balance and a hairspring comprising a same first material, said balance comprising a plate with a thickness in a range from 0.05 mm to 0.3 mm., said first material comprising a diamond, quartz or ceramic, one or more of said balance and said hairspring further comprising a coating with nanoparticles of a material having a coefficient of thermal expansion of 20 to $2\times10^{-10}$/° C.

2. A mechanical oscillator according to claim 1, wherein said balance comprises an arbor holding said plate and counterweights mounted on said plate, and said arbor and said counterweights are produced from at least one second material.

3. A mechanical oscillator according to claim 2, wherein said arbor is produced from hardened steel and at least one part of the counterweights is produced from heavy material, the density of which is greater than 15 g/cm$^3$.

4. A mechanical oscillator according to claim 1, wherein the first material has a low coefficient of thermal expansion of a maximum of $2\times10^{-6}$/° C.

5. A mechanical oscillator according to claim 1, wherein the first material is non-magnetic.

6. A mechanical oscillator according to claim 1, wherein the apparent density of the first material is comprised in a range from 2.0 to 5.0 g/cm$^3$.

7. A mechanical oscillator according to claim 1, wherein the first material is diamond-based.

8. A mechanical oscillator according to claim 1, wherein the timepiece is a wristwatch.

9. A mechanical oscillator according to claim 1, wherein said nanoparticles material has a maximum coefficient of thermal expansion of $2\times10^{-6}$/° C.

10. A mechanical oscillator according to claim 1, wherein said nanoparticules material is non-magnetic.

11. A mechanical oscillator according to claim 1, wherein said nanoparticles material has an apparent density in a range from 2.0 to 5.0 g/cm$^3$.

12. A mechanical oscillator according to claim 1, wherein the balance and the hairspring are coated in nanoparticles of diamond.

13. A mechanical oscillator for a timepiece comprising:

a balance and a hairspring, wherein the balance comprises:

a plate comprising a first material, said plate having a thickness comprising a range from 0.05 mm to 0.3 mm, an arbor holding said plate, whereby the balance swivels about a swivel axis, counterweights mounted on said plate, distributed symmetrically in relation to said swivel axis, said hairspring comprising a second material and said first material and said second material comprising at least one of diamond and quartz, wherein at least one of said balance and said hairspring further comprises a coating with nanoparticles of a material having a coefficient of thermal expansion of 20 to $2\times10^{-10}$/° C.

14. A mechanical oscillator according to claim 13, wherein said first material and said second material are identical.

15. A mechanical oscillator according to claim 13, wherein at least one part of said counterweights has a cylindrical shape in relation to an axis of symmetry in the part of it that is fitted into said plate, said counterweights having a symmetrical structure in relation to the axis of symmetry.

16. A mechanical oscillator according to claim 13, wherein said counterweights are produced from a third material having a specific gravity greater than 10.

17. A mechanical oscillator according to claim 16, wherein the third material is heavy material with a density greater than 15 g/cm$^3$.

18. A mechanical oscillator according to claim 13, wherein the first material is diamond.

19. A mechanical oscillator according to claim 13, wherein said nanoparticles material has a maximum coefficient of thermal expansion of $2\times10^{-6}$/° C.

20. A mechanical oscillator according to claim 13, wherein said nanoparticules material is non-magnetic.

21. A mechanical oscillator according to claim 13, wherein said nanoparticles material has an apparent density in a range from 2.0 to 5.0 g/cm$^3$.

22. A mechanical oscillator according to claim 13, wherein the balance and the hairspring are coated in nanoparticles of diamond.

23. A method of balancing by removing material from a balance for a mechanical oscillator, the method comprising:

providing a balance and a hairspring, wherein the balance comprises:

a plate comprising a first material, said plate having a thickness in a range from 0.05 mm to 0.3 mm, an arbor holding said plate, whereby the balance swivels about a swivel axis, counterweights mounted on said plate, distributed symmetrically in relation to said swivel axis, said hairspring comprising a second material and said first material and said second material comprising at least one of diamond and quartz, one or more of said balance and said hairspring comprising a coating of nanoparticles material having a coefficient of thermal expansion of 20 to $2\times10^{-10}$/° C., wherein at least one part of said counterweights has a cylindrical shape in relation to an axis of symmetry in the part of one of said counterweights that is fitted into said plate, said counterweights having a symmetrical structure in relation to the axis of symmetry;

removing material from at least one of said symmetrical counterweights symmetrically in relation to the axis of symmetry.

24. A method of balancing by removing material from a balance for a mechanical oscillator according to claim 23, wherein said nanoparticles material has a maximum coefficient of thermal expansion of $2\times10^{-6}$/° C.

25. A method of balancing by removing material from a balance for a mechanical oscillator according to claim 23, wherein said nanoparticules material is non-magnetic.

26. A method of balancing by removing material from a balance for a mechanical oscillator according to claim 23, wherein said nanoparticles material has an apparent density in a range from 2.0 to 5.0 g/cm$^3$.

27. A method of balancing by removing material from a balance for a mechanical oscillator according to claim 23, wherein the balance and the hairspring are coated in nanoparticles of diamond.

28. A method of balancing by adding material to a balance for a mechanical oscillator, the method comprising:

providing a balance and a hairspring, wherein the balance comprises:

a plate comprising a first material, said plate having a thickness in a range from 0.05 mm to 0.3 mm, an arbor holding said plate, whereby the balance swivels about a swivel axis, counterweights mounted on said plate, distributed symmetrically in relation to said swivel axis, said hairspring comprising a second material and said first material and said second material comprising diamond and quartz, at least one of said balance and said hairspring comprising a coating of nanoparticles material having a coefficient of thermal expansion of 20 to $2\times10^{-10}/°$ C., wherein at least one part of said counterweights has a cylindrical shape in relation to an axis of symmetry in the part of one of said counterweights that is fitted into said plate, said counterweights having a symmetrical structure in relation to the axis of symmetry;

adding material to at least one of said symmetrical counterweights symmetrically in relation to the axis of symmetry.

29. A method of balancing by adding material to a balance for a mechanical oscillator according to claim 28, wherein said nanoparticles material has a maximum coefficient of thermal expansion of $2\times10^{-6}/°$ C.

30. A method of balancing by adding material to a balance for a mechanical oscillator according to claim 28, wherein said nanoparticules material is non-magnetic.

31. A method of balancing by adding material to a balance for a mechanical oscillator according to claim 28, wherein said nanoparticles material has an apparent density in a range from 2.0 to 5.0 $g/cm^3$.

32. A method of balancing by adding material to a balance for a mechanical oscillator according to claim 28, wherein the balance and the hairspring are coated in nanoparticles of diamond.

* * * * *